United States Patent [19]

Nelson

[11] 4,045,068

[45] Aug. 30, 1977

[54] BALL PICK-UP, STORAGE, AND INDIVIDUAL DELIVERY DEVICE

[76] Inventor: James Irwin Nelson, R.D. 2, Ironia Road, Mendham, N.J. 07945

[21] Appl. No.: 687,915

[22] Filed: May 19, 1976

[51] Int. Cl.[2] ..... A63B 47/02

[52] U.S. Cl. ..... 294/19 A; 221/63

[58] Field of Search ..... 294/19 R, 19 A; 221/45, 221/58, 59, 63, 199, 226, 271, 276, 279, 281, 309, 310; 56/328 R

[56] References Cited

U.S. PATENT DOCUMENTS

| | | | |
|---|---|---|---|
| 1,810,491 | 6/1931 | McClure | 221/199 |
| 2,760,807 | 8/1956 | Watson | 294/19 A |
| 2,768,775 | 10/1956 | Houser | 221/309 UX |
| 3,206,067 | 9/1965 | Smith et al. | 221/310 X |
| 3,344,955 | 10/1967 | Ingham | 294/19 A X |
| 3,371,950 | 3/1968 | Stap | 294/19 A X |
| 3,412,897 | 11/1968 | Slater | 221/310 X |
| 3,820,836 | 6/1974 | Seewagen et al. | 294/19 A |

FOREIGN PATENT DOCUMENTS

| | | | |
|---|---|---|---|
| 2,427,362 | 11/1975 | Germany | 294/19 A |

*Primary Examiner*—Johnny D. Cherry

*Attorney, Agent, or Firm*—Alexander T. Kardos

[57] ABSTRACT

A ball pick-up, storage, and individual delivery device comprising: an elongated tubular canister capable of receiving and storing a plurality of balls therein; ball guiding and retaining fins at one end of the elongated tubular canister for guiding the balls into the elongated tubular canister and retaining them therein, after the ball guiding and retaining fins has been placed over and around the balls one at a time and pressed downwardly around the balls to squeeze them and force them to enter the elongated tubular canister; a spring located within the elongated tubular canister urging the balls in the direction of the ball guiding and retaining fins with the outermost ball contacting the ball guiding and retaining fins; and a base located at the other end of the elongated tubular canister having a sufficiently large surface area as a base to permit the elongated tubular canister to be inverted and to stand upright thereon, with the outermost ball contacting the guiding and retaining fins in position to be picked out individually at approximately waist-high level or higher by a person using the ball pick-up, storage, and individual delivery device.

3 Claims, 4 Drawing Figures

FIG. 1
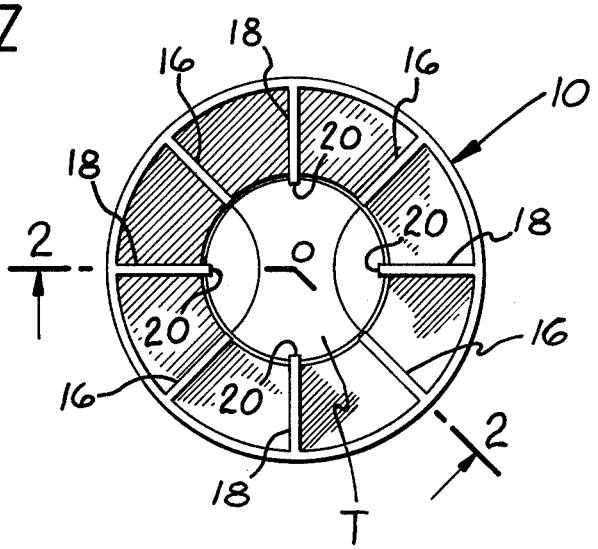
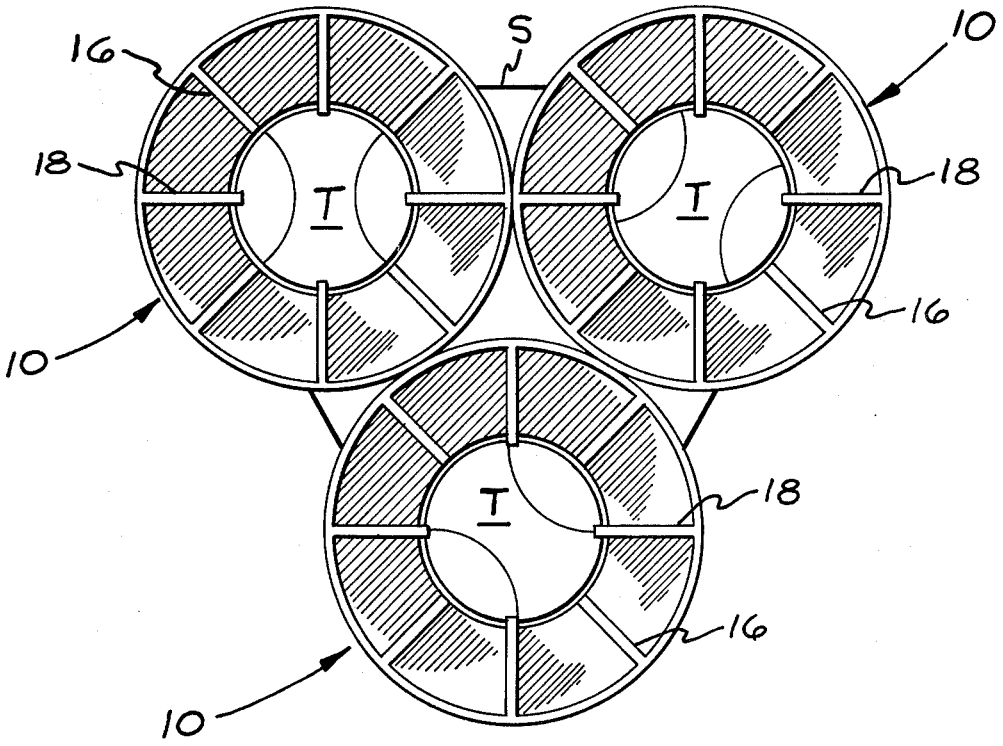
FIG. 4

BALL PICK-UP, STORAGE, AND INDIVIDUAL DELIVERY DEVICE

THE FIELD OF THE PRESENT INVENTION

The present invention relates to ball pick-up, storage, and individual delivery devices, and, more particularly, is concerned with such devices for use with balls which are squeezable and deformable by manual or digital pressure. Most particularly, the present invention is concerned with such devices for use with tennis balls.

THE GENERAL BACKGROUND OF THE PRESENT INVENTION

Whenever people have professional instructional lessons, or they practice a sport or a game, such as tennis, for example, they usually like to have a number of balls close to them so that they can practice hitting them, or serving them, in relatively close succession in repetitive fashion. After they have hit all the balls which are then laying around on the ground or on the playing surface of the tennis court at various distances from the person who is practicing, they must be picked up or retrieved so that they can be hit or served again. This task of picking or retrieving the tennis balls requires a considerable amount of bending over, or stooping, in order to reach the tennis balls. This, of course, is hard on the spine and the back muscles and is tiresome and very wearying and ultimately productive of back aches and pains. Also, it is time consuming, which is particularly undesirable if the person who is practicing is taking expensive professional instruction or has rented the use of the tennis court or practice area for a stipulated period of time and naturally would prefer spending as much of that time in practicing and as little of that time as is possible in bending over and picking up stray tennis balls. There are tennis ball retrieving devices which are presently commercially available, such as described and illustrated in U.S. Pats. Nos. 3,371,950 and 3,889,996 which issued on Mar. 5, 1968 and June 17, 1975, respectively, which permit the person who is practicing to pick up and retrieve tennis balls which are lying on the ground or on the playing surface of the tennis court without requiring them to bend over or stoop in such tiresome and wearying fashion. These devices are capable of picking up the tennis balls and placing them in a receptacle or container from which they are removed subsequently and used in the next practice session.

These tennis ball retrieving devices do eliminate some of the undesirable bending over and stooping during the picking up process but, when the tennis balls are being subsequently used in the next practice session, the person who is practicing must bend over and pick a tennis ball out of the receptacle or container, the bottom portion of which usually rests on the ground or on the playing surface of the tennis court. This is not too bad at the outset when the receptacle or container is completely full, inasmuch as such requires only a partial bending over or stooping to reach a tennis ball but gradually gets worse as the supply of balls in the receptacle or container becomes depleted, so that the person using such a device is soon bending over and stooping as much as ever to pick tennis balls out of the lower portion or the bottom of the receptacle or container.

PURPOSES AND OBJECTS OF THE PRESENT INVENTION

It is therefore a principal purpose and object of the present invention to provide a suitable device which is capable of picking up or retrieving tennis balls lying on the ground or the playing surface of a tennis court or practice area, storing a plurality of such pick-up tennis balls in a storage canister, and then making the tennis balls individually available at approximately waist-high level or higher for subsequent practice sessions and thus substantially avoiding the necessity of bending over or stooping at any time, either to pick up or retrieve a tennis ball, or to use or re-use the tennis ball in a subsequent practice session.

BRIEF SUMMARY OF THE PRESENT INVENTION

It has been found that such principal purposes and objects of the present invention, as well as other principal purposes and objects which will become clearer from a further reading and understanding of this specification, can be achieved by providing a ball pick-up, storage, and individual delivery device which comprises: an elongated tubular canister capable of receiving and storing a plurality of balls therein; ball guiding and retaining means located at one end of the elongated tubular canister for guiding the balls into the elongated tubular canister and retaining them therein, after the ball guiding and retaining means has been placed over and around the balls one at a time and pressed downwardly around the balls to squeeze them and force them to enter the elongated tubular canister; spring means located within the elongated tubular canister urging the balls in the direction of the ball guiding and retaining means with the outermost ball contacting the ball guiding and retaining means; and a base located at the other end of the elongated tubular canister covering a sufficiently large surface area as a base as to permit or enable the elongated tubular canister to be inverted and stand upright thereon, with the outermost ball contacting the ball guiding or retaining means in position to be picked out individually approximately at waist-high level or above by a person using the ball pick-up, storage, and individual delivery device.

BRIEF DESCRIPTION OF THE DRAWINGS

In the following specification and accompanying self-explanatory drawings, there are described and illustrated typical and preferred embodiments of the present invention but it is to be understood that such is primarily merely for descriptive and illustrative purposes. The boarder aspects of the present inventive concept are therefore not to be construed as limited to such typical and preferred embodiments, except as defined and limited by the scope of the appended claims.

Also, although the present invention will be described and illustrated with more particular reference to the use with tennis balls, it is to be appreciated that the principles of the present inventive concept are equally applicable to other types and kinds of balls having equivalent properties and characteristics.

Figure 3:
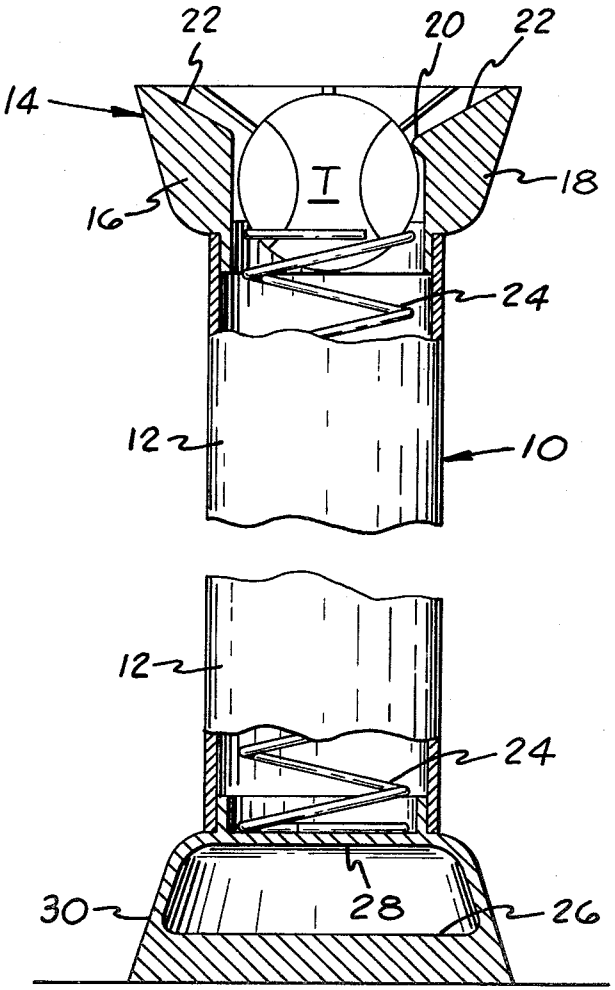
Figure 2:
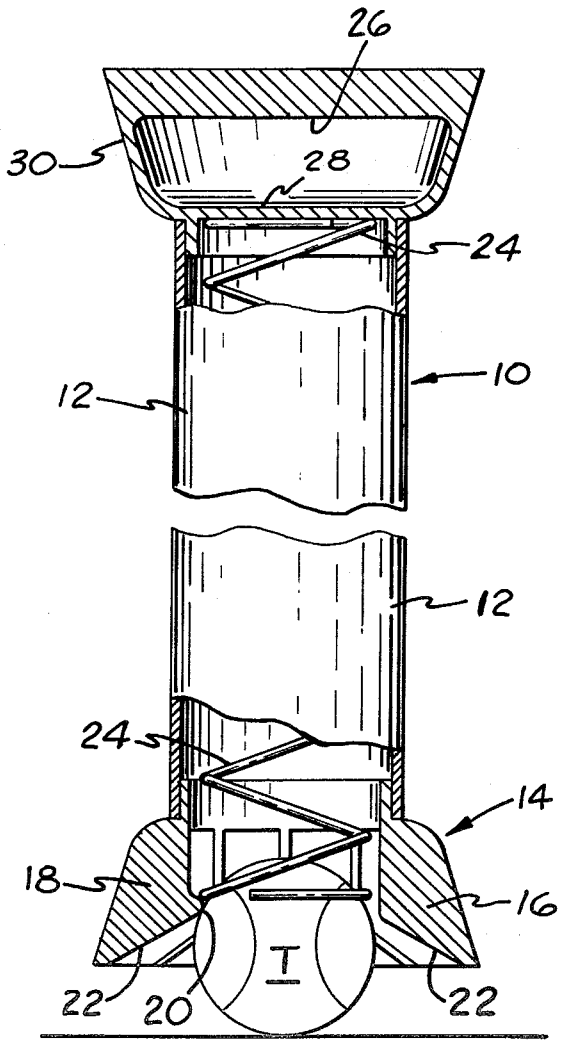

Referring to the accompanying drawings,

FIG. 1 is an end plan view of one embodiment of the ball pick-up, storage, and individual delivery device of the present invention;

FIG. 2 is an elevational view, partially in cross-section, of the ball pick-up, storage, and individual delivery device of FIG. 1, the cross-section being primarily taken on the line 2–0–2 of FIG. 1, with the device in position for picking up balls, with some portions thereof cutaway to show more clearly some of the internal construction of the device;

FIG. 3 is an elevational view, partially in cross-section, of the ball pick-up, storage, and individual delivery device of FIG. 1, the cross-section being primarily taken on the line 2–0–2 of FIG. 1, with the device in position for delivering balls, with some portions thereof cutaway to show more clearly some of the internal construction of the device; and FIG. 4 is an end plan view of another embodiment of the ball pick-up, storage, and individual delivery device of the present invention, having an increased capacity for receiving and storing balls.

DESCRIPTION OF THE PREFERRED EMBODIMENT

As shown in the accompanying drawings, the ball pick-up, storage, and individual delivery device 10 of the present invention comprises an elongated tubular canister 12, preferably in the form of a hollow, right circular cylinder having a length of from about 30 inches to about 42 inches, and normally from about 34 inches to about 38 inches and an internal diameter in the range of from about 2⅝ inches to about 2⅞ inches, and normally from about 2-11/16 inches to about 2¾ inches. The thickness of the walls of the elongated tubular canister 12 will depend in large measure upon the properties and characteristics of the particular material used in its manufacture and normally is in the range of from 0.030 inch to about 0.100 inch. Thinner or thicker wall may be used in special circumstances.

The elongated tubular canister 12 is capable of receiving and storing from about 10 to about 15 tennis balls, and normally from about 12 to about 14 tennis balls, which balls officially have a diameter of more than about 2½ inches and less than about 2⅝ inches, when new and unused, although, as they are used in practice or in games, they tend to lose their surface nap and decrease in diameter. This is basically true for all tennis balls, even though some are manufactured for special types of tennis court surfaces; or for various elevations, such as high altitude tennis balls; or for various kinds of light conditions, such as yellow balls for use under gray or darkening skies; or in various weights, ranging from very light (2 ounces) to very heavy (2-1/6 ounces) for various types of players.

The elongated tubular canister 12 is made of various kinds of materials, such as sufficiently strong paper, cardboard, chipboard, or other paper products, which may be coated or impregnated with various waterproofing, wet-strengthening, or other improvement agents; suitable synthetic or man-made plastic materials, such as polystyrene, polycarbonates, amino resins, phenolic resins, polyolefins, acrylic resins, vinyl resins, cellulosic resins, or other polymeric materials; or a metal such as aluminum, magnesium, stainless or other steels, or alloys of these and other metals.

At one end of the elongated tubular canister 12 is a ball pick-up portion 14 which, as will be learned from a further reading and understanding of this specification, will subsequently become a ball delivery portion. The ball pick-up portion 14 comprises a plurality of ball guiding and retaining fingers or fins 16 and 18. As shown in the drawings, especially FIG. 2, there are four guiding fins 16 which are somewhat shorter and smaller than the four guiding and retaining fins 18 which are additionally formed with relatively small ball-retaining knobs 20 at their inner ends. The ball guiding and retaining fins 16 and 18 are made of the materials mentioned previously herein for the elongated tubular canister 12 and are relatively firm, rigid and unyielding, especially when contrasted to the softness, and the pliant and yielding nature of a tennis ball.

The outline of a tennis ball T is shown in the drawings and it is to be appreciated how the ball retaining knobs 20 originally resist the entry of a tennis ball T into the interior of the elongated tubular canister 12 (see FIG. 2) and then subsequently tend to retain the tennis ball T within the elongated tubular canister 12 (see FIG. 3). The distance between two diametrically opposed ends of the ball retaining knobs 20 of the guiding and retaining fins 18 is in the range of from about 2-5/16 and about 2-7/16 inches.

It is not essential that there be only four guiding fins 16 and four guiding and retaining fins 18 with ball retaining knobs 20 thereon. All eight fins may be guiding and retaining fins which are provided with retaining knobs thereon. Or, if desired, there may be a total of ten fins which may be divided unto into five guiding fins and five guiding and retaining fins with ball retaining knobs thereon, or all ten fins may be the guiding and retaining fins provided with ball retaining knobs thereon.

As noted in the drawings, all the guiding and retaining fins 16 and 18 are radially disposed and are equally spaced around the periphery of the elongated tubular canister 12. The guiding and retaining fins 16 and 18 are relatively thin and create a plurality of interdigital spaces therebetween, for a purpose which will become clearer from a further reading and understanding of this specification.

All the guiding and retaining fins 16 and 18 are formed with inwardly inclined, sloping cam surfaces 22 which tend to guide and to direct the tennis ball T to a centrally-located position, such as the axis of the elongated tubular canister, as shown in FIG. 2, should it initially not be exactly in that desirable location for being picked up by the ball pick-up, storage, and individual delivery device 10.

Consideration of FIG. 2 will reveal how, if the elongated tubular canister 12 is not initially positioned exactly directly over the tennis ball T to be picked up, the inwardly inclined, sloping cam surfaces 22 will cam and move the tennis ball T toward the centrally-located position, as shown in FIG. 2.

THE PICKING UP OF THE BALL

In any event, when the elongated tubular canister 12 is placed over a tennis ball and is pressed downwardly around the tennis ball T, it is squeezed and slightly compressed by the ball retaining knobs 20 and is sufficiently deformed or distorted temporarily so that it is forced upwardly, as viewed in FIG. 2, past the ball retaining knobs 20 to move into the interior of the elongated tubular canister 12. The ball T immediately and resiliently returns substantially completely to its original spherical shape.

Also, at the same time, the tennis ball T contacts and slightly compresses a helical compression spring 24 so that the tennis ball T is immediately urged downwardly against the inner sides of the ball retaining knobs 20. The pressure and force exerted by the helical compression spring 24 is insufficient, however, to force the tennis ball T past the ball retaining knobs 20 and out of the elongated tubular canister 12.

The ball picking-up or retrieving procedure is repeated, one ball at a time, and additional tennis balls T are forced into the interior of the elongated tubular canister 12 until it is completely filled. During this time, the elongated tubular canister 12 is held generally vertically, as shown in FIG. 2. A handle 26 is provided to facilitate the holding and manipulating of the device 10 and is secured to the inner walls of a generally bowl-shaped circular cap 28 which serves to cover the end of the elongated tubular canister 12 opposite to that of the ball pick-up end 14. The outer end of the bowl-shaped cap 28 widens out considerably and serves a purpose to be described in greater detail hereinafter.

The helical spring 24 may be secured, if desired, to the inner side of the bowl-shaped cap 28 or it may be loose within the elongated tubular canister 12. Its outside diameter is in the range of from about 2-3/16 inches to about 2¾ inches, depending upon the internal diameter of the elongated tubular canister 12 and the spacing between the ball retaining knobs 20. The compression of the helical compression spring gradually increases as the elongated tubular canister 12 is being filled and finally reaches a point of maximum compression when the elongated tubular canister 12 is completely filled with tennis balls T. The outermost or last helical coil of the compression spring is decreased in size slightly so that a tennis ball will fit comfortably therein, as shown in FIGS. 2 and 3.

THE DELIVERING OF THE TENNIS BALLS

When the elongated tubular canister 12 is filled, it is carried to the location where the person using the device desires to hit, or to serve, the tennis balls T. The elongated tubular canister 12 is inverted, turned upside down, and is placed on the ground or the playing surface of the tennis court. The enlarged outer end 30 of the bowl-shaped cap 28 is annular and has a sufficiently large diameter and large surface area coverage as to enable the elongated tubular canister 12 to stand substantially vertically upright in a stable condition. In such an inverted configuration, the former ball picking-up portion 14 is no longer at the lower end of the elongated tubular canister 12 but has become the upper end thereof, as shown in FIG. 3.

The person using the device 10 then inserts his fingers between the equally spaced, radially oriented guiding and retaining fins 16 and 18 and is able to grasp the outermost or top ball T which is being urged by the helical compression spring 24 against the ball retaining knobs 20 and to individually pick it out of the elongated tubular canister 12. That particular tennis ball T is then hit, or served, and, when the person using the device 10 desires another tennis ball, then he easily and simply picks another ball out of the elongated tubular canister 12. While this is being done, the tennis ball T is compressed and squeezed to a small degree. However, such does not harm the tennis ball, particularly when one realizes the tremendous compression and deformation that ordinarily takes place when one hits the tennis ball during a hard serve or an overhead smash.

It is to be observed that, when the person using the device 10 removes a tennis ball T from the elongated tubular canister 12, the helical compression spring 24 immediately pushes the next tennis ball T upwardly against the ball retaining knobs 20 so that it becomes available to be picked out next, again at waist-high level. The pressure or force exerted by the helical compression spring 24 is sufficient to do so but is not sufficiently strong as to force the next tennis ball retaining means. During this time, the annular base 30 which has a strut-like handle 26 crossing it as a diameter keeps the elongated tubular canister 12 on an even keel with very little danger of its tipping over. Thus, it can be seen that the former ball-picking up portion 14 has become the ball delivering portion.

In FIG. 4, there is illustrated a modification of the ball pick-up, storage, and individual delivery device 10 wherein three elongated tubular canisters 16 are secured together such as by a strap, for example, or by any other fastening or securing means. In this way, there is provided an increased capacity for receiving and storing tennis balls T.

The present invention will be further described with particular reference to the following specific Examples, wherein there are disclosed typical and preferred embodiments of the present invention. However, it is to be stated that such specific Examples are primarily illustrative of the present invention and are not to be construed as limitative of the broader aspects of the present inventive concept, except as defined and limited by the scope and spirit of the appended claims.

EXAMPLE I

The tennis ball pick-up, storage, and individual delivery device illustrated in FIGS. 1-3 is used in this Example. The elongated tubular canister is made of rolled paper tube coated with polystyrene plastic. The ball pick-up portion (which subsequently becomes the ball delivery portion) and the base are made of high impact strength polycarbonate resin. The helical compression spring is made of 0.085 inch diameter stainless steel music wire. It has an outside diameter of 2-7/16 inches.

The length of the elongated tubular canister is 34 inches and its internal diameter is 2-11/16 which is slightly larger than the largest diameter of a new, unused tennis ball of 2⅝ inches. It is capable of holding up to 12 tennis balls. There are four ball guiding fins and four ball guiding and retaining fins with ball retaining knobs thereon. The fins are equally spaced around the periphery of the elongated tubular canister and extend radially, being angularly spaced by 45° from one another. The distance between diametrically opposed ball retaining knobs is 2-5/16 inches.

The device is used to retrieve tennis balls lying on the ground and does so very satisfactorily without requiring any bending over or stooping. When the canister is filled, it is turned upside down and placed on its base which is the end opposite to that of the picking-up end. Such base has an enlarged annular periphery which provides stability to the device in its inverted position. The outside diameter of the enlarged annular periphery of the base is 5 inches. The tennis balls are simply and easily removed by the fingers of the person using the device at approximately waist-high level one at a time without requiring bending over or stooping. The device performs satisfactorily.

EXAMPLE II

The procedures set forth in Example I are followed substantially as described therein with the exception that the ball pick-up portion and the base are made of polystyrene molded plastic. The results of this Example are generally comparable to the results obtained in Example I.

EXAMPLE III

The procedures set forth in Example I are followed substantially as described therein with the exception that the three basic parts of the device, namely, the elongated tubular canister, the ball pick-up portion, and the base are made of molded polystyrene plastic. The results of this Example are generally comparable to the results of Example I.

EXAMPLE IV

The procedures set forth in Example I are followed substantially as described therein with the exception that the elongated tubular canister is 42 inches long, rather than 34 inches long. Except for the increased capacity, the results of this Example are generally comparable to the results obtained in EXAMPLE I.

EXAMPLE V

The procedures set forth in Example I are followed substantially as described therein with the exception that there are ten guiding and retaining fins arranged in equidistant, radially oriented fashion around the periphery of the elongated tubular canister, separated by angles of 36° each. Five fins are merely guiding fins and five are guiding and retaining fins with ball retaining knobs thereon. The device performs satisfactorily and the person using the device is easily able to insert his fingers between the fins to grasp and remove a tennis ball from the elongated tubular canister.

EXAMPLE VI

The procedures set forth in Example I are followed substantially as described therein with the exception that all the basic parts of the device, except the helical compression spring, are made of medium density, molded polypropylene plastic. The results of this Example are generally comparable to the results of Example I.

EXAMPLE VII

The procedures set forth in Example I are followed substantially as described therein with the exception that three devices are strapped together to triple the ball receiving and storing capacity of the device. The multi-capacity device performs satisfactorily.

Although several specific Examples of the present inventive concept have been described in particularity, the same should not be construed as limiting the present ivention to the specific materials and procedures mentioned therein but to include various other kinds and types of materials and procedures, as well as other equivalent features, as set forth in the scope and spirit of the claims appended hereto. It is understood that any reasonable or suitable changes, modifications, and variations may be made without departing from the principles and the broader aspects of the inventive concept.

What is claimed is:

1. A tennis ball pick-up, storage, and individual delivery device comprising: an elongated tubular canister for receiving and storing and individually delivering a plurality of tennis balls; tennis ball guiding and retaining means located at one end of said elongated tubular canister for guiding tennis balls individually into said elongated tubular canister and for retaining them therein, said tennis ball guiding and retaining means being located at the lower end of said elongated tubular canister when the tennis balls are to be guided into said elongated tubular canister and at the upper end of said elongated tubular canister when the tennis balls are to be delivered from said elongated tubular canister; spring means located within said elongated tubular canister for urging the tennis balls within said elongated tubular canister in the direction of said tennis ball guiding and retaining means, with the outermost tennis ball contacting said tennis ball guiding and retaining means; and a sufficiently enlarged base located at the other end of said elongated tubular canister opposite to the end where said tennis ball guiding and retaining means are located, providing a handle for the person picking up tennis balls with the tennis ball pick-up, storage, and individual delivery device and having a sufficiently large surface base area to enable said elongated tubular canister to be inverted and to stand substantially vertically upright thereon in inverted but stable fashion on the ground or on the playing surface of a tennis court, with said tennis ball guiding and retaining means being located at the upper end of said elongated tubular canister when the tennis balls are to be individually delivered from said elongated tubular canister and with the outermost tennis ball in position to be removed individually at a constant height at approximately waist-high level or above from said elongated tubular canister by a person using the tennis ball pick-up, storage, and individual delivery device without being required to bend over or stoop during either the picking-up or delivering of the tennis balls, said tennis balls being squeezable and compressible, and capable of being deformed and distorted by manual or digital pressure but being sufficiently resilient as to return substantially immediately to their original spherical shape when the manual or digital pressure is removed, said tennis ball guiding and retaining means comprising a plurality of relatively firm, rigid and unyielding fins which are sufficiently spaced from each other as to permit the fingers of a person using the device to enter therebetween to grasp and remove tennis balls individually, said relatively firm, rigid and unyielding fins extending radially outwardly from the center or axis of said elongated tubular canister, with their inner ends forming an opening slightly smaller than the cross-sectional area of a tennis ball, whereby pressure is required to squeeze and deform the tennis balls to enable them to be collected and guided into said elongated tubular canister or to permit them to be delivered individually from said elongated tubular canister.

2. The device as defined in claim 1 wherein there are eight guiding and retaining fins.

3. The device as defined in claim 1 wherein there are ten guiding and retaining fins.

* * * * *